United States Patent [19]

Strickland

[11] Patent Number: 4,971,678

[45] Date of Patent: Nov. 20, 1990

[54] LIQUID INVENTORY CONTROL IN AN EBULLATED BED PROCESS

[75] Inventor: John C. Strickland, Houston, Tex.

[73] Assignee: Texaco Inc., White Plains, N.Y.

[21] Appl. No.: 211,750

[22] Filed: Jun. 27, 1988

[51] Int. Cl.[5] ..... C10G 47/00

[52] U.S. Cl. ..... 208/162; 208/112; 208/137; 208/177

[58] Field of Search ..... 208/112, 162, 95, 100, 208/157, 177

[56] References Cited

U.S. PATENT DOCUMENTS

| | | | |
|---|---|---|---|
| Re. 25,770 | 4/1965 | Johanson | 208/408 |
| 2,706,167 | 4/1955 | Harper et al. | 196/35 |
| 3,003,580 | 10/1961 | Lanning | 208/162 |
| 3,188,286 | 6/1965 | Van Driesen | 208/108 |
| 3,539,499 | 11/1970 | Chervenak et al. | 208/143 |
| 3,549,517 | 12/1970 | Lehman et al. | 208/108 |
| 3,622,265 | 11/1971 | Weber et al. | 23/1 F |
| 3,635,943 | 1/1972 | Stewart | 208/112 |
| 3,668,116 | 4/1972 | Adams et al. | 208/216 |
| 3,677,716 | 7/1972 | Weber et al. | 23/288 |
| 3,681,231 | 8/1972 | Alpert et al. | 208/112 |
| 3,698,876 | 10/1972 | Gregoli et al. | 23/288 |
| 3,725,247 | 4/1973 | Johnson et al. | 208/111 |
| 3,819,331 | 6/1974 | Weber | 23/284 |
| 3,870,623 | 3/1975 | Johnson et al. | 208/108 |
| 4,151,073 | 4/1979 | Comolli | 208/340 |
| 4,221,653 | 9/1980 | Cheruenak et al. | 208/408 |
| 4,354,852 | 10/1982 | Kydd | 23/230 |

*Primary Examiner*—Anthony McFarlane

*Attorney, Agent, or Firm*—Jack H. Park; Kenneth R. Priem; Richard A. Morgan

[57] ABSTRACT

The invention is an improvement in an ebullated bed process. Gas is removed the ebullated bed reactor preferentially to liquid. Gas is removed by material balance control until the reactor, including the recycle conduit is liquid full. Foam, generated around the recycle cup and riser conduits is floated upward by liquid and does not enter the recycle conduit. When steady state is achieved, liquid and gas are both removed from the reactor under material balance control.

1 Claim, 2 Drawing Sheets

LIQUID INVENTORY CONTROL IN AN EBULLATED BED PROCESS

CROSS-REFERENCE TO RELATED APPLICATION

This application is related to J. C. Strickland U.S. patent application, Ser. No. 07/746 filed June 27, 1988, for a Liquid Degaser In An Ebullated Bed Process.

This application is also related to S. M. Sayles U.S. patent application Ser. No. 06/897,233 Filed Aug. 18, 1986 For Gas-Liquid Separation in An Ebullated Bed Process.

BACKGROUND OF THE INVENTION

1. Field of the Invention

This invention relates to means for withdrawing gaseous effluents preferentially to liquid effluents in an ebullated bed process. The invention also related to improved control of an ebullated bed process. The control relates to removing gas preferentially to removing liquid from an ebullated bed reactor.

2. Description of Other Relevant Methods in the Field

The ebullated bed process comprises the passing of concurrently flowing streams of liquids or slurries of liquids and solids and gas through a vertically cylindrical vessel containing catalyst. The catalyst is placed in random motion in the liquid and has a gross volume dispersed through the liquid medium greater than the volume of the mass when stationary. This technology has found commercial application in the upgrading of heavy liquid hydrocarbons or converting coal to synthetic oils.

The process is generally described in E. S. Johanson U.S. Pat. No. Re 25,770 incorporated herein by reference. A mixture of hydrocarbon liquid and hydrogen is passed upwardly through a bed of catalyst particles at a rate such that the particles are forced into random motion as the liquid and gas pass upwardly through the bed. The catalyst bed motion is controlled by a recycle liquid flow so that at steady state, the bulk of the catalyst does not rise above a definable level in the reactor. Vapors along with the liquid which is being hydrogenated pass through that upper level of catalyst particles into a substantially catalyst free zone and are removed at the upper portion of the reactor.

In an ebullated bed process the substantial amounts of hydrogen gas and light hydrocarbon vapors present rise through the reaction zone into the catalyst free zone. Liquid is both recycled to the bottom of the reactor and removed from the reactor as product from this catalyst free zone. Vapor is separated from the liquid recycle stream before being passed through the recycle conduit to the recycle pump suction. The recycle pump (ebullation pump) maintains the expansion (ebullation) and random motion of catalyst particles at a constant and stable level. Gases or vapors present in the recycled liquid materially decrease the capacity of the recycle pump as well as reduce the liquid residence time in the reactor and limit hydrogen partial pressure.

Reactors employed in a catalytic hydrogenation process with an ebullated bed of catalyst particles are designed with a central vertical recycle conduit which serves as the downcomer for recycling liquid from the catalyst free zone above the ebullated catalyst bed to the suction of a recycle pump to recirculate the liquid through the catalytic reaction zone. The recycling of liquid from the upper portion of the reactor serves to ebullate the catalyst bed, maintain temperature uniformity through the reactor and stabilize the catalyst bed.

M. C. CherVenak et al. U.S. Pat. No. 4,221,653. describes an apparatus for separating vapor from liquid in an ebullated bed process. The apparatus comprises a frusto-conical cup in which are inserted a plurality of riser conduits. The conduits are positioned in two concentric circles within the cup. The generic term for the recycle gas-liquid separator apparatus in an ebullating bed process is a recycle cup. The recycle cup of the Chervenak et al. patent and those like it with a plurality of riser conduits are referred to as a tubular recycle cup.

It is a critical feature of the recycle cup that the upflowing liquid-gas mixture rising from the reaction zone passes through the riser conduits of the separation apparatus and that lower ends of all conduits are below the reactor liquid level.

After passage through the recycle cup, the gas portion rises to the top of the reactor. Part of the liquid portion is returned through a downcomer conduit and recycled to the reaction zone. The remaining liquid portion is withdrawn from the reactor as liquid product. The returned liquid portion passe through s the recycle conduit to a recycle pump, then passes through a liquid-gas distribution means, together with fresh liquid and hydrogen feed to maintain uniform upward fluid flow through the ebullated catalyst bed. Liquid and vapor are withdrawn through a conduit extending into the reactor adjacent the separator apparatus.

A. G. Comolli U.S. Pat. No. 4,151,073 and P. H. Kydd U. S. Pat. No. 4,354,852 recognize the advantages of effecting the recycle liquid-vapor separation in an ebullated bed process by feeding the fluid tangentially to a cylindrical separator. By this method, the hot fluid is fed to the cylindrical separator at conditions to prevent carbonaceous particulate material from depositing on the interior surface of the separator. These conditions include tangential injection of feed to the separator, fluid temperature of 550° F. to 900° F. and a separator length/diameter ratio of 20/1 to 50/1. The Kydd patent additionally teaches that a liquid vortex in the cylindrical separator reduces coke deposition.

J. I. Harper et al. U.S. Pat. No. 2,706,167 teaches an ebullated bed process wherein in the drawing, liquid and vapor are withdrawn from the reactor separately.

R. P. Van Driessen U.S. Pat. No. 3,188,286 teaches an apparatus for carrying out an ebullated bed process. The apparatus comprises a treating vessel; means for introducing liquid, gas and catalyst into the vessel; a withdrawal conduit extending into the upper portion of the vessel having a vertically extending screen portion positioned to maintain an upper level in the vessel and to permit gas and liquid to separately enter the conduit for withdrawal from the vessel.

C. L. Weber et al. U.S. Pat. No. 3,677,716; 3,622,265 and 3,819,331 teach an apparatus for gas-liquid-solid phase separation for use in an ebullated bed process. The apparatus comprises gas disengaging means, a solid setting chamber enclosed such that liquids and solids within the chamber are substantially out of contact with the turbulent zone and means to withdraw gas.

M. C. Chervenak et al. U.S. Pat. No. 3,539,499 teaches an ebullated bed process wherein vertical baffles above the dense catalyst phase are used to reduce entrainment of undissolved hydrogen and entrained gases in the liquid product.

L. M. Lehman et al. U.S. Pat. No. 3,549,517 teaches an ebullated bed process wherein in the drawing, liquid and vapor are withdrawn from the reactor separately.

C. E. Adams et al. U.S. Pat. No. 3,668,116 teach an ebullated bed process wherein in the drawing, a liquid cyclone is used for separation.

A. A. Gregoli et al.U.S. Pat. No. 3,698,876 teaches an ebullated bed process. In the process a funnel shaped apparatus with vertically mounted vanes is used in the internal liquid recycle conduit for vapor-liquid disengagement.

DETAILED DESCRIPTION OF THE DRAWINGS

In order to demonstrate and provide a better understanding of the invention, reference is made to the drawings.

Figure 1:
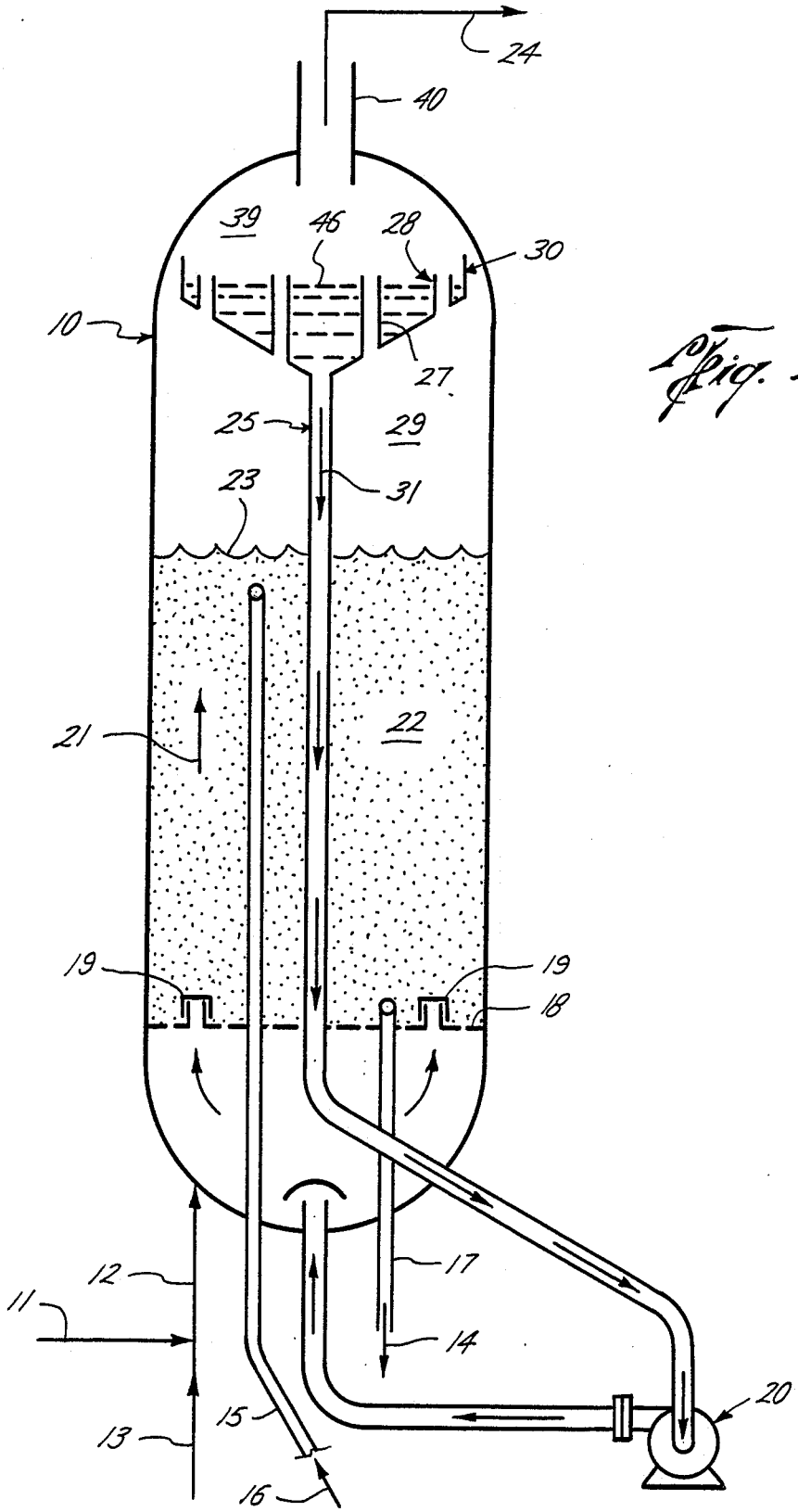
FIG. 1 is a sectional elevated view of a reaction vessel containing a tubular recycle cup vapor-liquid separation apparatus.

The invention is further illustrated by reference to FIG. 1. Reaction vessel 10 is positioned with its long axis in a vertical position and is generally of a circular cross section. Although this FIG. 1 drawing is schematic in order to show its various features, it will be understood that the reactor is constructed in such a fashion and from such materials that it is suitable for reacting liquids, liquid-solid slurries, solids and gases at elevated temperatures and pressures and in a preferred embodiment for treating hydrocarbon liquids with hydrogen at high pressures and high temperatures, e.g. 100 to 5000 psi and 300°F. to 1500°F. The reactor 10 is fitted with a suitable inlet conduit 12 for feeding heavy oil and a hydrogen-containing gas. Outlet conduits are located in the upper portion of reactor 10; outlet conduit 40 designed to withdraw vapor and liquid stream 24. The reactor also contains means for introducing and withdrawing catalyst particles, which are shown schematically as conduit 15 through which fresh catalyst 16 is flowed and conduit 17 through which spent catalyst 14 is withdrawn.

Heavy oil feedstock is introduced through conduit 11, while hydrogen-containing gas is introduced through conduit 13, and may be combined with the feedstock and fed into reactor 10 through conduit 12 in the bottom of the reactor. The incoming fluid passes through grid tray 18 containing suitable fluid distribution means. In this drawing, bubble caps 19 are shown as the fluid distribution means, but it is to be understood that any suitable device known in the ar which will uniformly distribute the fluid coming from conduit 12 over the entire cross-sectional area of reactor 10 may be utilized.

The mixture of liquid and gas flows upwardly, and the catalyst particles are thereby forced into an ebullated movement by the gas flow and the liquid flow delivered by recycle pump 20 (ebullation pump) which may be either internal or external to the reactor 10. The upward liquid flow delivered by this recycle pump 20 is sufficient to cause the mass of catalyst particles in catalytic reaction zone 22 (catalyst bed) to expand by at least 10% and usually by 20 to 100% over the static volume, thus permitting gas and liquid flow as shown by direction arrow 21 through reactor 10. Due to the upwardly directed flow provided by the pump and the downward forces provided by gravity, the catalyst bed particles reach an upward level of travel or ebullation while the lighter liquid and gas continue to move upward beyond that level. In this drawing, the upper level of catalyst or catalyst-liquid interface is shown as interface 23, and the catalytic reaction zone 22 extends from grid tray 18 to level 23. Catalyst particles in catalytic reaction zone 22 move randomly and are uniformly distributed through the entire zone in reactor 10.

At steady state, few catalyst particles rise above catalyst-liquid interface 23. The catalyst depleted zone 29, above the interface 23, is filled with liquid and entrained gas or vapor. Gas and vapor are separated from liquid in the recycle cup 30 to collect and recycle a liquid with a substantially reduced gas and vapor content through recycle conduit 25 of generally circular cross-sectional area. A gas and liquid stream 24 is withdrawn through reactor outlet conduit 40.

The enlarged upper end of recycle conduit 25 is the recycle cup 30 of horizontally circular cross-section. A plurality of vertically directed riser conduits 27 and 28 provides fluid communication between catalyst depleted zone 29 and phase separation zone 39. Gas-entrained liquid moves upwardly through the riser conduits 27 and 28, and upon leaving the upper ends of these riser conduits, a portion of the fluid reverses direction and flows downward through recycle conduit 25 in the direction of arrow 31 to the inlet of recycle pump 20 and thereby is recycled to the lower portion of reactor 10 below grid tray 18. Gases and vapors which are separated from the liquid, rise to collect in the upper portion of reactor 10 and are removed through reactor outlet conduit 40. The gases and vapors removed at this point are treated using conventional means to recover as much hydrogen as possible for recycle to conduit 13.

Figure 2:
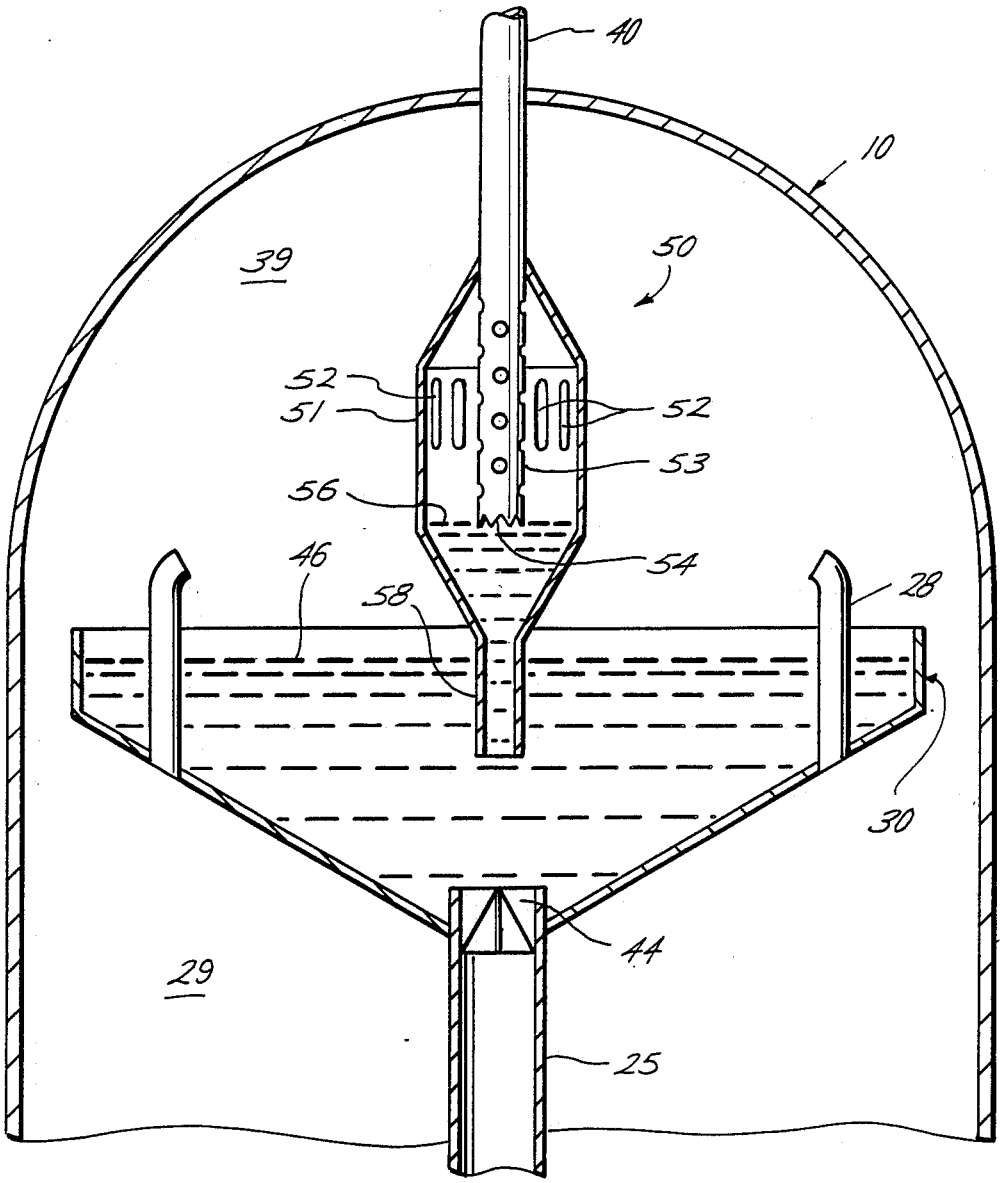
FIG. 2 is a sectional view of reactor outlet conduit in combination with a preferential separator apparatus.

Reference is made to FIG. 2, a sectional view of a reactor outlet conduit in combination with an apparatus for removing gas preferentially to liquid. The apparatus 50 is an axial flow liquid trap. The apparatus 50 comprises, a cylindrical body 51 in which are positioned a number of tangential entry slots 52 for entry of liquid and vapor from phase separation zone 39. Tangential entry slots 51 cause tangential entry of liquid and vapor into cylindrical body 51 and thereby initiate a cyclonic spin on the entering components. Liquid and vapor separate by inertia with vapor passing through entrance 54 of reentrainment conduit 53 where it flows via reactor outlet conduit 40 out of reactor 10. Entrance 54 shown as saw toothed may alternatively be beveled, slotted, comprise a plurality of vertically spaced holes or any other means for passing vapor in the presence of liquid or mixed phase. Liquid travels along cylindrical body 51 to trap liquid level 56 which is elevated from cup liquid level 46. Liquid has two possible flow modes, a first flow mode and a second flow mode.

In the first flow mode, trap liquid level 56 is entirely below entrance 54 and only gas enters liquid reentrainment conduit 53. Liquid flows through liquid return conduit 58, past vortex breaker 44 into recycle conduit 15, and is recycled within the reactor.

In a second flow mode, trap liquid level 56 is coincident with entrance 54 and both gas and liquid enter liquid reentrainment conduit 53. In this mode, separated liquid must reentrain with vapor in conduit 53 to maintain the material balance between inlet mass flows 11 and 13 and outlet flow 24.

SUMMARY OF THE INVENTION

In an ebullated bed process a hydrogen-containing gas and a fluent hydrocarbon feedstock are introduced into the lower end of a generally vertical catalyst containing reaction vessel. The velocity of the gas and feed stock is sufficient to fluidize the catalyst, thereby expanding the volume of the catalyst bed to greater than its static volume. The mixture of feedstock, gas and catalyst constitutes a turbulent zone. The upper portion of the turbulent zone is defined by a catalyst depleted zone. Liquid is recycled is replaced from the catalyst depleted zone to the lower end of the turbulent zone. Liquid hydrocarbon and gas is also removed from the catalyst deplete zone. In the improved process the reactor is maintained in material balance by removing gas preferentially to removing liquid from the catalyst depleted zone.

DESCRIPTION OF THE PREFERRED EMBODIMENTS

It is apparent from a review of the patent literature that gas entrainment in the recycle conduit is of particular concern. A number of devices for improving gas-liquid separation in the reactor have been proposed for improving the separation of gas from the liquid flowing to the recycle conduit. Gas entrainment in the recycle liquid has been theorized as a cause of instability in catalyst bed fluidization. Investigators have theorized that the amount of vapor carried down the recycle conduit is so great that a true liquid phase does not exist at the ebullation pump suction. In the most severe manifestation, major flow fluctuations of liquid through the pump have been noted. Such flow fluctuations are symptomatic of foaming or gas entrainment.

Given the physical properties of the fluids and the hydraulic conditions of the ebullation pump suction it is reasonable to conclude that foaming or entrainment is inherent to the ebullated bed process and that a new method of operating the process is required to avoid the inherent carriage of vapor into the recycle conduit in the ebullated bed process.

This new method is developed from the accepted concept that foaming is inherent in the environment of the recycle conduit and recycle cup of the ebullated bed process. However it is a novel recognition that although foaming occurs, it resides only in locations within the reactor which are not sufficiently flooded with liquid. The instant method effects the flooding of the recycle conduit with liquid, forcing foam to reside in the reactor only above the recycle cup. The method achieves liquid flooding of the recycle conduit by preferentially removing vapor from the reactor to maintain material balance. According to the instant invention, when vapor resides in the recycle cup, a device at the reactor outlet preferentially allows only vapor to pass out of the reactor. By the difference in density, liquid is driven down the recycle conduit, displacing foam from the conduit and toward the top of the reactor where the foam is preferentially removed.

Another way of analyzing the method is to recognize that the ebullated bed process is only in quasi steady state when foam is in the recycle conduit adjacent the recycle pump suction. It is important to note that there is reason to believe that vapor or foaming is not generated at the recycle pump suction. Bench scale models have shown foam is carried from the recycle cup down to the recycle conduit. It is not generated at the pump suction in quantity. It is the object of the invention to move the equilibrium of the process from a quasi steady state to a true stable steady state. This is achieved by forcing the reactor, by material balance, to be liquid full rather than partially liquid full and partially foam full. This is achieved by flooding the recycle conduit with liquid and floating the foam from the recycle cup wherein in the steady state the foam will not affect the internal circulation of liquid and hence will not interfere with bed ebullation by cavitating the recycle pump.

To this end, inventor also has invented a centrifugal device which is used to achieve the method of the invention.

While particular embodiments of the invention have been described, it is well understood that the invention is not limited thereto since modifications may be made. For example, a number of devices are envisioned to preferentially remove vapor from the reactor. It is therefore contemplated to cover by the appended claims any such modifications as fall within the spirit and scope of the claims.

What is claimed is:

1. In a continuous process for treating a fluid hydrocarbon feedstock with a hydrogen-containing gas at elevated catalytic reaction temperatures and pressure in the presence of a bed of particulate solid catalyst, comprising introducing the hydrogen-containing gas and feedstock into the lower end of a generally vertical reaction vessel containing catalyst at sufficient velocity whereby the catalyst is placed in random motion within the fluid hydrocarbon and is expanded to a volume greater than its static volume, wherein the mixture of feedstock, gas and catalyst constitutes a turbulent zone, the upper portion of which is defined by a catalyst depleted zone comprising liquid, gas and foam, wherein liquid is recycled from the catalyst depleted zone to the lower end of the turbulent zone, the improvement which comprises:

removing gas from said catalyst depleted zone, and removing liquid from said catalyst depleted zone in the absence of gas to maintain material balance, thereby forcing foam to the upper portion of the catalyst depleted zone and excluding foam from recycle with liquid to the lower end of the turbulent zone.

* * * * *